United States Patent [19]

Cheng

[11] Patent Number: 4,863,284

[45] Date of Patent: Sep. 5, 1989

[54] REINFORCED JOINT, PARTICULARLY FOR SECURING PULL-TYPE RIBBON TO A DECORATIVE CARRYING CONTAINER

[76] Inventor: Peter S. C. Cheng, 5 Ross Street, Toronto, Ontario, Canada, M5T 1Z8

[21] Appl. No.: 260,296

[22] Filed: Oct. 20, 1988

[51] Int. Cl.[4] ..... B65D 33/06

[52] U.S. Cl. ..... 383/18; 53/413; 383/29; 428/4; 493/226

[58] Field of Search ..... 383/17, 18, 29; 428/4; 493/226; 53/413; 150/110; 190/115

[56] References Cited

U.S. PATENT DOCUMENTS

| | | | |
|---|---|---|---|
| 1,624,522 | 4/1927 | Weistock et al. | 383/18 |
| 1,671,928 | 5/1928 | Groh | 383/18 |
| 1,696,085 | 12/1928 | Gibson et al. | 383/18 |
| 1,713,747 | 5/1929 | Deubener | 383/18 |
| 2,047,095 | 7/1936 | Booth | 383/18 |
| 2,093,687 | 9/1937 | Kluger | 150/110 |
| 2,447,964 | 8/1948 | Slindee | 383/18 |
| 2,925,841 | 2/1960 | Brunner | 190/115 |
| 4,608,283 | 8/1986 | White | 428/4 |
| 4,777,066 | 10/1988 | White et al. | 428/4 |
| 4,809,353 | 2/1989 | Cheng | 383/6 |

*Primary Examiner*—Stephen P. Garbe

*Attorney, Agent, or Firm*—Kirschstein, Ottinger, Israel & Schiffmiller

[57] ABSTRACT

A reinforced joint secures opposite ends of a ribbon serving as a carrying handle for a decorative container. The opposite ribbon ends are adhered and clamped to each other, and are adhered to the container in longitudinal alignment and in an overlapping relationship.

17 Claims, 4 Drawing Sheets

FIG. 5
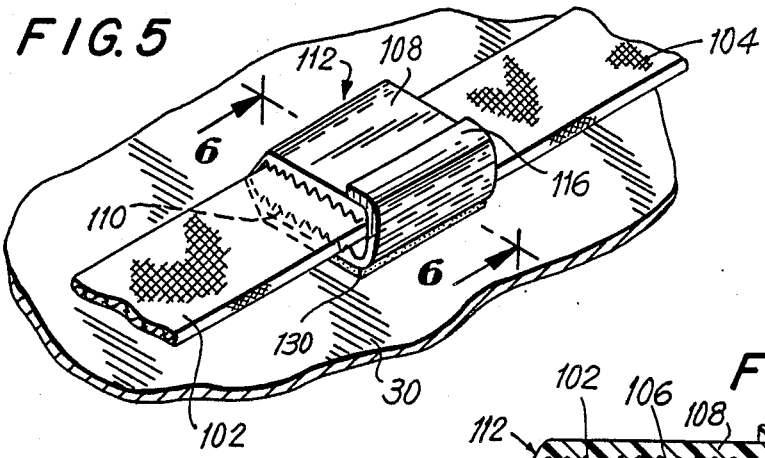
FIG. 6
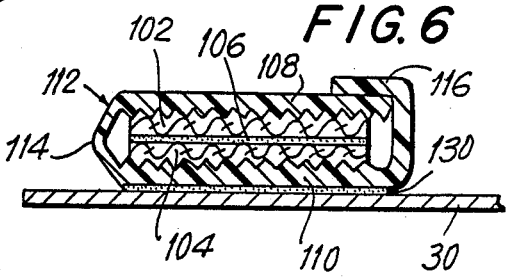
FIG. 7
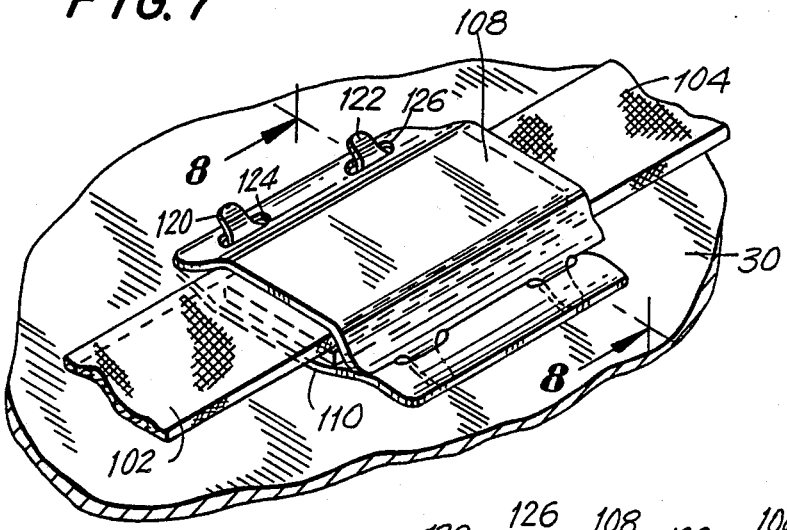
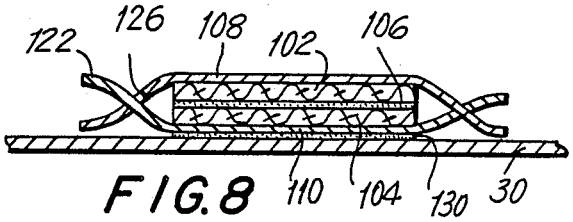
FIG. 8

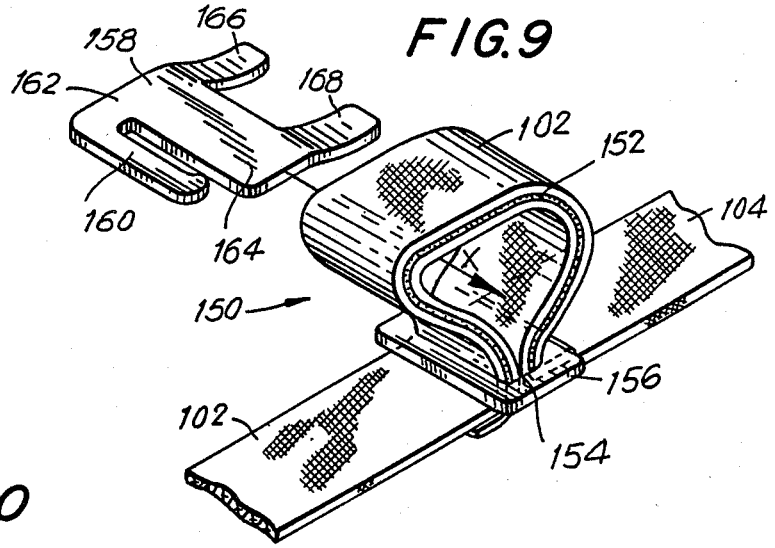
FIG. 9
FIG. 10
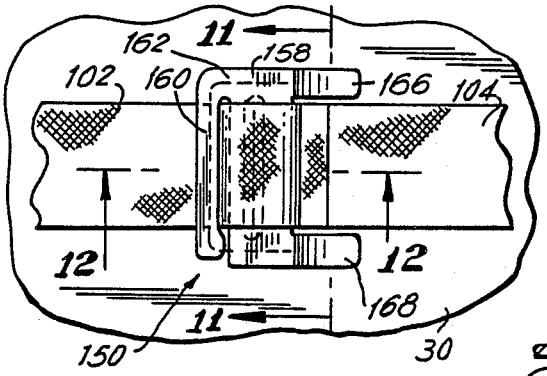
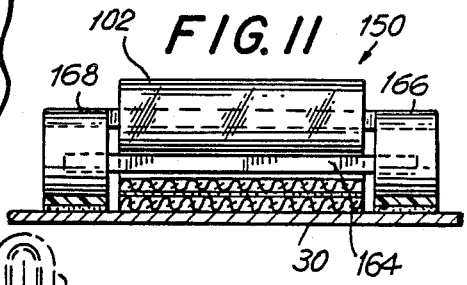
FIG. 11
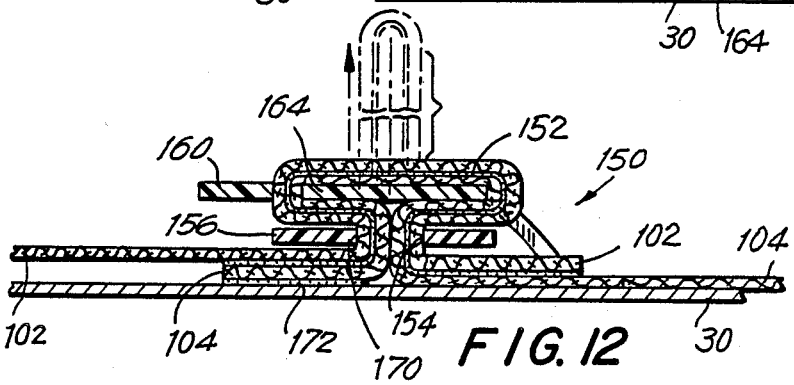
FIG. 12

REINFORCED JOINT, PARTICULARLY FOR SECURING PULL-TYPE RIBBON TO A DECORATIVE CARRYING CONTAINER

BACKGROUND OF THE INVENTION

1. Field of the Invention

This invention generally relates to a reinforced joint for, and method of, reliably securing opposite ends of a ribbon to each other and, more particularly, for securing opposite ends of a pull-type ribbon to a decorative carrying container of the type having a pull-type ribbon which, when pulled, simultaneously forms a decoration for adorning the container and a carrying handle for carrying an object inside the container.

2. Description of Related Art

In my pending U.S. Pat. No. 4,809,353, Feb. 28, 1989, and entitled "Carrier with Simultaneous Formation of Carrying Handle and Decorative Bow", the entire contents of which are hereby incorporated herein by reference, various decorative carriers were disclosed. Each carrier had an actuator, e.g. a pull-type ribbon, which, when pulled, simultaneously formed a carrying handle on the carrier for carrying the carrier and any object placed therein from place to place, and also formed a decoration on the carrier for adorning the carrier.

In one advantageous application, a retailer would place a shopper's gift purchase inside a container, such as a shopping bag and, thereupon, by pulling the ribbon, would form a decoration, such as a bow, on the bag and, at the same time, would form a carrying handle to carry the bag. The shopper could deliver the decorated bag, as is, to a prospective gift recipient without having to resort to the fuss and bother of attaching separate bows, or wrapping the gift in wrapping paper.

However, the known decorative carriers sometimes have not proven to be altogether satisfactory when many and very heavy objects are placed within the container, because the combined weight of the objects tends to detach the ends of the ribbon from the container. Typically, one end of the ribbon is glued to an upper marginal portion of the bag, and the opposite end of the ribbon passes through a hole in a wall of the bag and is configured as a bow located exteriorly of the bag wall adjacent the hole. When the weight of the objects is sufficiently high, sometimes the glued end of the ribbon separates from the upper marginal portion of the bag and/or the opposite bow-configured end of the ribbon is pulled through said hole. In either or both of these latter described events, the usefulness of the decorative carrier has been compromised.

SUMMARY OF THE INVENTION

1. Objects of the Invention

It is a general object of this invention to overcome the above noted drawbacks of the prior art.

It is another object of this invention to provide a decorative carrier of the kind described capable of carrying heavy objects.

It is a further object of this invention to reliably secure to such a decorative carrier opposite ends of a ribbon serving as a carrying handle therefor.

Another object of this invention is to provide a reinforced joint capable of reliably securing opposite ends of a ribbon o analogous strap to each other and, if desired, for reliably securing the joint to a container.

2. Features of the Invention

In keeping with these objects, and others which will become apparent hereinafter, one feature of this invention resides, briefly stated, in a reinforced joint for, and in a method of, joining opposite, generally planar, longitudinally extending, and overlapping end regions of a ribbon or analogous strap to each other, and preferably to a container in which an object is placed. In a preferred embodiment, the ribbon is preferably of the pull type and, when pulled, not only forms a carrying handle, but also forms a decoration for adorning the container.

The reinforced joint comprises means for pressing the overlapping ribbon end regions toward each other. The pressing means includes a pair of generally planar clamping portions, each located at an outer surface of a respective ribbon end region and being in pressing contact with the respective ribbon end region for maintaining the ribbon end regions in longitudinal alignment and in an overlapping relationship.

The clamping portions can be hinged for pivoting movement between clamped and unclamped positions and integrated in a one-piece construction as part of a clip of resilient material. Alternatively, the clamping portions may be separate plates mountable on and off each other between clamped and unclamped positions. Means are advantageously provided for locking the clamping portions in the clamped position. One plate may, in a variant construction, have an opening through which the ribbon end regions are inserted as a loop; and the other plate may be a clip in which a clamping portion thereof is received in the loop.

The joint further advantageously comprises an adhesive layer disposed between the overlapping ribbon end regions. The adhesive layer adheres the overlapping ribbon end regions to each other and further strengthens the joint.

Means may also be provided for securing the pressing means and, in turn, the overlapping ribbon end regions to the container. Advantageously, an adhesive coating is applied between one of the clamping portions or one of the ribbon end regions and a wall of the container, preferably an interior surface of a bottom wall of the container. The adhesive coating resists displacement of the overlapping ribbon end regions relative to the container, even when heavy objects are placed therein and pull the ribbon end regions in opposite longitudinal directions.

The clamping portions may extend longitudinally past the overlapping ribbon end regions. In a modification, each clamping portion may have a ribbed, undulating surface which bears against the outer surface of a respective ribbon end region.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 5 is an enlarged sectional view of one embodiment of a reinforced joint according to this invention;

FIG. 6 is an enlarged perspective view of the joint of FIG. 5;

FIG. 7 is an enlarged sectional view of another embodiment of a reinforced joint according to this invention;

FIG. 8 is an enlarged perspective view of the joint of FIG. 7;

FIG. 9 is a partly exploded, front perspective view of another embodiment of a reinforced joint according to this invention;

FIG. 10 is a reduced size top plan view of the joint of FIG. 9;

FIG. 11 is a sectional view taken on line 11—11 of FIG. 10 looking in the direction of the arrows; and FIG. 12 is a sectional view taken on line 12—12 of FIG. 10 looking in the direction of the arrows.

DETAILED DESCRIPTION OF THE PREFERRED EMBODIMENTS

Figure 3:
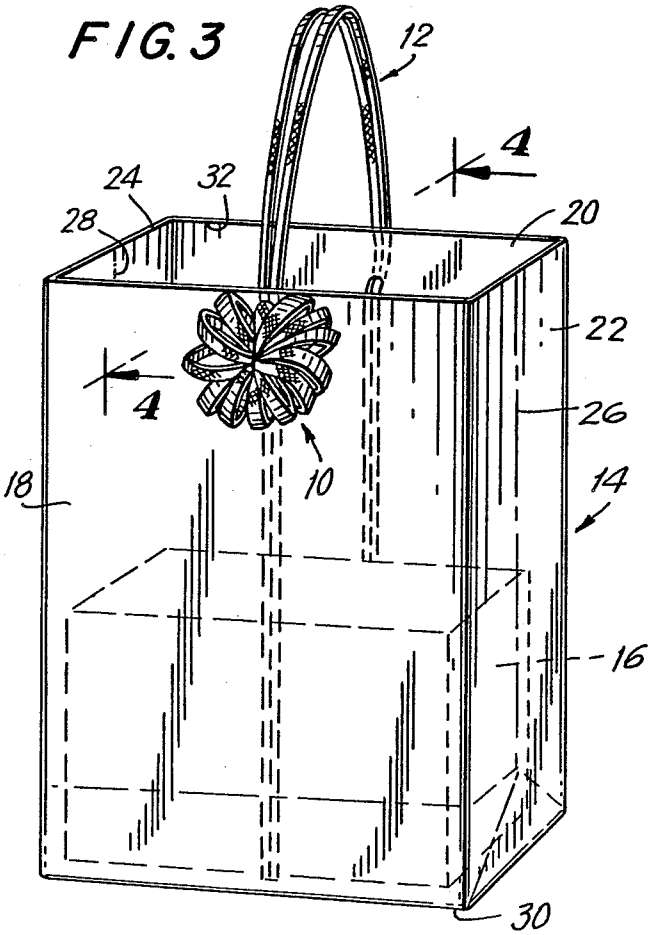
FIG. 3 is a view analogous to FIG. 1 showing the carrying container with a formed decoration and formed carrying handle for use with the ribbon joint of this invention.

As best shown in FIG. 3, a decorative bow 10 and a carrying handle 12 are simultaneously formed on an article 14 to be carried. As shown, the article 14 is a container, preferably a shopping bag made of paper, plastic and like materials, although the invention is not intended to be so limited since any container or article is within the spirit of this invention. An object 16, such as a gift item, is contained within the bag 14 for delivery and presentation with the decorated carrier bag 14.

The bag 14 has a front wall 18, a rear wall 20, a pair of side walls 22, 24, each foldable about upright longitudinal creases 26, 28, a closed bottom wall 30, and a top opening 32 through which the object 16 passes into and out of the bag. The bag 14 is of the expandible type. Initially, the bag is in a collapsed state with the front 18 and rear 20 walls lying flat against each other, and with the top opening 32 closed. When the front and rear walls are moved away from each other, the top opening 32 is opened, thereby allowing access to the interior of the bag through the top opening 32.

Figure 4:
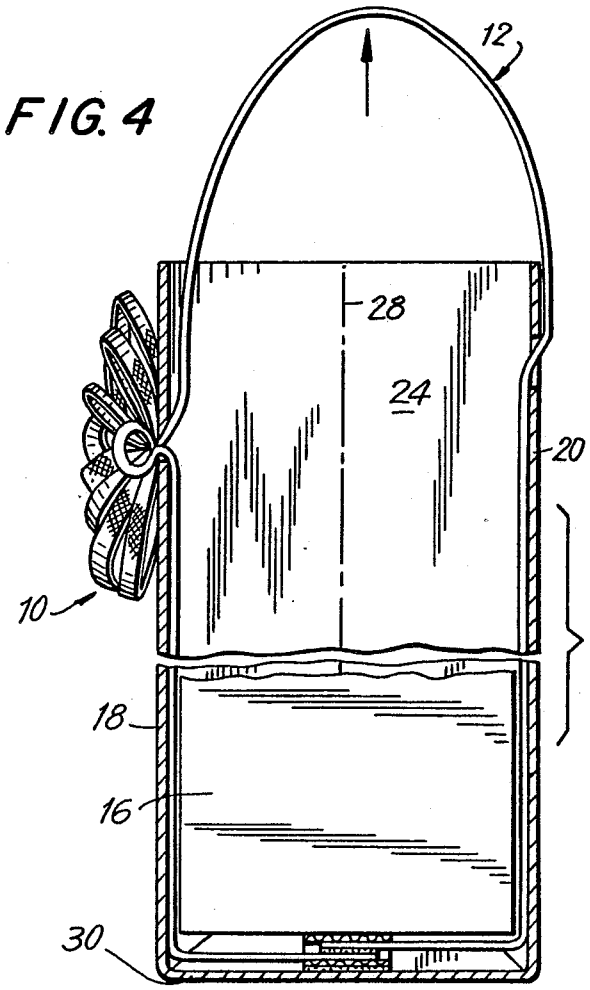
FIG. 4 is an enlarged sectional view taken on line 4—4 of FIG. 3 looking in the direction of the arrows.

A bow forming means, including a pair of bow ribbons 40, 42, are suspended freely from an upper marginal edge region of the front wall 18. The ribbons 40, 42 may be two separate ribbons tied together at common end 44, or, preferably, a single ribbon folded over at common end 44. Retainers or clips 46, 48 are mounted at an angle relative to the elongation of the bow ribbons at spaced-apart locations along the ribbons 40, 42 to form a plurality of elongated bow sections 40*a*, 42*a* and 40*b*, 42*b*. Each clip gathers the ribbons into close confinement, and forms each bow section with opposite ends. Each ribbon is advantageously made of a material separate from that of the bag 14. The ribbons are supported by the bag for movement relative to the bag walls from a bow-unformed, generally collapsed, position (see FIGS. 1 and 2) to a bow-formed, generally three-dimensional, looped position (see FIGS. 3 and 4).

Figure 1:
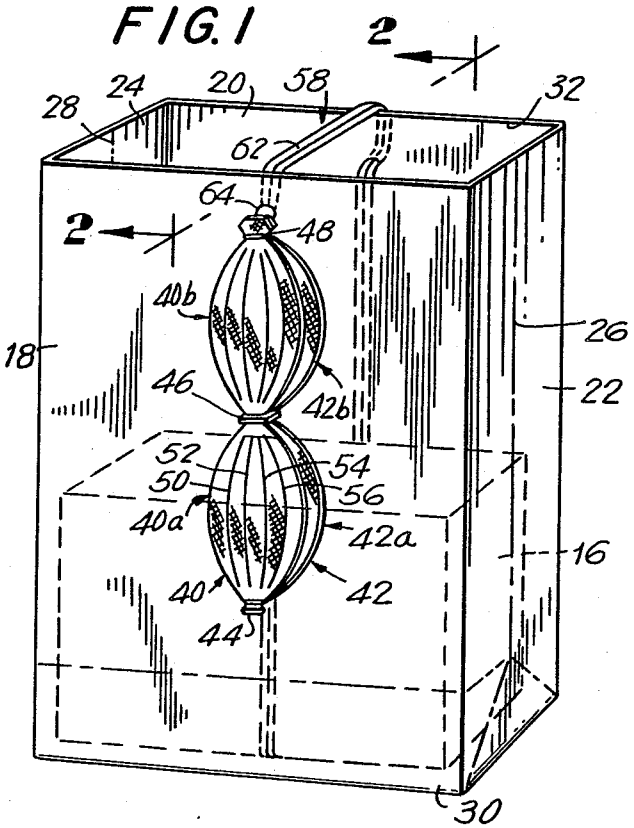
FIG. 1 is a front perspective view of a carrying container having an unformed decoration and unformed carrying handle for use with the ribbon joint of this invention.

The bow ribbons 40, 42 do not have linear edges, but, instead, have scalloped edges. Each bow ribbon consists of a plurality of oval sections. In FIG. 1, two oval sections for each ribbon generally resemble the numeral eight. Furthermore, each bow section is slit along curved slits 50, 52, 54, 56 so that each section is formed of a plurality of loop-forming elements.

Actuating means, including a drawstring 58 having an actuating portion 60 and a handle portion 62 is mounted on the bag and is operatively connected to the bow forming means. The drawstring 58 is preferably constituted of a generally planar, thin ribbon, and can be one, or, as illustrated, two side-by-side ribbons. In operation, as explained below, the drawstring is operative to simultaneously form the bow 10 and the carrying handle 12.

In the bow-unformed position, the actuating portion 60 extends between the ribbons and passes loosely through the clips 46, 48. An intermediate region of the actuating portion is connected and tied with a knot to the common end 44 of the ribbons. The actuator portion and the ribbons are suspended as an integral assembly at the exterior of the bag. The intermediate region of the actuator portion is routed through a first aperture 64 into the interior of the bag along two courses. The first course extends across the top opening 32 before being routed through a second aperture 66 to the interior of the bag, and then along the height of the rear wall 20 before being routed along the bottom wall 30 and terminating in a first ribbon end region 102. The second course extends along the height of the front wall 18 before being routed along the bottom wall 30 and terminating in a second ribbon end region 104. The ribbon end regions 102, 104 are secured to each other and to the bag at reinforced joint 100, as described below.

In use, an operator need only grasp and pull on the handle portion 62 to effect relative movement between the handle portion and the front wall. The ribbon end regions 102, 104 are fixed at the joint 100 and cannot move; however, the common end 44 is free to move, and moves toward the front wall. During this movement, the actuating portion 60 slides through the inclined clips 46, 48, and folds the opposite ends of each loop-forming element of each bow section toward each other, thereby forming individual loops which tend to be rotated about the elongations of the bow ribbons and together form a circular array constituting the bow. The actuating portion 60 also passes through the aperture 64 and adds its length to the handle portion 62, thereby forming the carrying handle 12 which serves as means for carrying the bag 14 and the object 16 from place to place.

In order to ensure that the ribbon end regions 102, 104 remain secured to the bottom wall 30 even when the ribbon end regions 102, 104 are pulled forcefully in opposite directions under the weight of a heavy object 16, the ribbon end regions are positioned in longitudinal alignment and in an overlapping relationship at the joint 100. An adhesive layer 106 is disposed between, and adheres, the overlapping and aligned ribbon end regions to each other, although the use of adhesive layer 106 is not strictly necessary.

A pair of generally planar clamping portions 108, 110 are respectively positioned at outer surfaces of the overlapping ribbon end regions. The clamping portions urge the overlapping ribbon end regions into pressing surface-to-surface contact with each other with the adhesive layer 106 sandwiched therebetween.

As best shown in FIGS. 5 and 6, the clamping portions 108, 110 are integrally formed as a resilient clip 112 and are hinged at living hinge 114 which is of reduced thickness as compared to the thickness of either clamping portion to facilitate pivoting movement from an unclamped position to the illustrated clamped position. A resilient catch 116 on one of the clamping portions, e.g. 110, lockingly engages the other clamping portion 108 in order to lock the clip in the clamped position. The inner surface of each clamping portion 108, 110 has an undulating, ribbed surface for bearing against a respective outer surface of the ribbon end regions.

As best shown in FIGS. 7 and 8, the clamping portions 108, 110 are separately formed as individual clamping plates detachably mounted off and on each other. Each plate has at least one projection, and preferably two projections 120, 122, as well as at least one slot, and preferably two slots 124, 126. Each slot on one plate lockingly receives a corresponding projection on the other plate, and thus maintains the plates in the illustrated clamped position.

Figure 2:
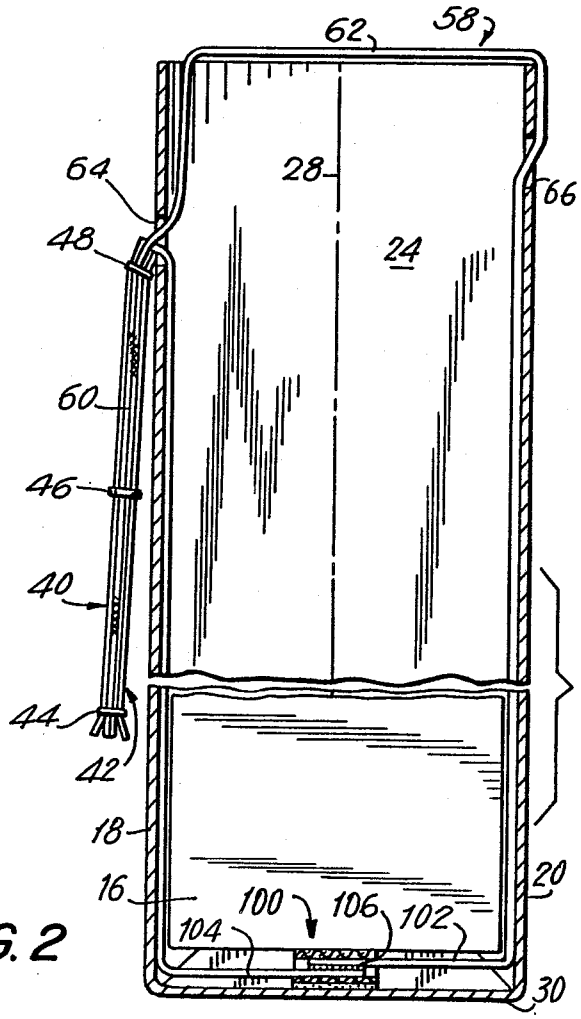
FIG. 2 is an enlarged sectional view taken on line 2—2 of FIG. 1 looking in the direction of the arrows.

As best shown in FIG. 2, the clamping portions may advantageously extend slightly past the overlapping ribbon end regions in both longitudinal directions.

Means, e.g. an adhesive coating 130, is disposed between one of the clamping portions, e.g. 110, and the bottom wall 30 of the container. The coating 30 secures the clamping portions and the overlapping ribbon end regions to the bottom wall. The coating 30 and the layer 106 are preferably pressure-sensitive glues.

Once the decoration and carrying handle are formed and a heavy object placed within the bag, the weight of the object will pull the handle end regions 102, 104 away from each other. The clamping portions re-direct such external forces and prevent the ribbon end regions from skewing, that is, from being positioned at an oblique angle relative to their mutual contact plane. The longitudinal alignment and the surface-to-surface area contact between the overlapping ribbon end regions are reliably maintained.

Turning now to the reinforced join 150 shown in FIGS. 9–12, ribbon end regions 102, 104 overlap each other and are positioned in longitudinal alignment. A two-sided tape or adhesive layer 152 is preferably located between the overlapping ribbon end regions. The ribbon end regions are then formed into a loop, as best shown in FIG. 9, and inserted through an opening 154 in a gate member 156. A locking member or clip 158 is hooked onto ribbon end region 102. The clip 158 has a clip portion 160 connected by a web 162 to a clamping portion 164, as well as a pair of guide legs 166, 168. The clamping portion 164 is inserted in the direction of arrow X into the loop until the legs 166, 168 straddle opposite side edges of the ribbon end regions (see FIG. 10). Once so inserted, the ribbon end regions are pulled apart, thereby closing the loop and bringing the clamping portion 164 to bear against the walls of the gate member 156 which bound the opening 154, said walls serving as a second clamping portion 170. Those portions of the ribbon end regions captured between the clamping portions 164, 170 are tightly secured to each other.

In the event that the adhesive layer 152 is not employed, it will be appreciated that the reinforced joint can be used as a readily detachable connector for strapping boxes, cartons and analogous containers. When the joint is to be connected to a container such as the decorative carrier described above, another adhesive layer 172 (see FIG. 12) is applied between one of the ribbon end regions, e.g. 104, and a wall of the container, e.g. bottom wall 30.

It will be understood that each of the elements described above, or two or more together, also may find a useful application in other types of constructions differing from the types described above.

While the invention has been illustrated and described as embodied in a reinforced joint for securing pull-type ribbon to a decorative carrying container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a container, a reinforced joint for joining opposite, generally planar, longitudinally extending, and overlapping ribbon end regions of a ribbon on the container to each other, said joint comprising:

(a) means for pressing the overlapping ribbon end regions toward each other, including a pair of generally planar clamping portions, each located at an outer surface of a respective ribbon end region and being in pressing contact with the respective ribbon end region for maintaining the ribbon end regions in longitudinal alignment and in an overlapping relationship; and (b) means for securing at least one of said pressing means and ribbon end regions to the container, for resisting displacement of the ribbon end regions relative to the container.

2. In a carrying container of the type having a ribbon which serves as a carrying handle during carrying of an object within the container, a reinforced joint for joining opposite, generally planar, longitudinally extending, and overlapping ribbon end regions of the ribbon to each other, said joint comprising:

(a) means for pressing the overlapping ribbon end regions toward each other, including a pair of generally planar clamping portions, each located at an outer surface of a respective ribbon end region and being in pressing contact with the respective ribbon end region for maintaining the ribbon end regions in longitudinal alignment and in an overlapping relationship; and (b) means for securing at least one of said pressing means and ribbon end regions to the container, for resisting displacement of the pressed and adhered ribbon end regions relative to the container when the ribbon end regions are pulled in opposite longitudinal directions by the weight of the object being carried in the container.

3. The reinforced joint as recited in claim 2, wherein the clamping portions are hinged for pivoting movement between clamped and unclamped positions.

4. The reinforced joint as recited in claim 3, wherein the pressing means includes means for locking the clamping portions in the clamped position.

5. The reinforced joint as recited in claim 2, wherein each clamping portion has a ribbed surface bearing against the outer surface of a respective ribbon end region.

6. The reinforced joint as recited in claim 2, wherein the clamping portions are individual plates mountable on and off each other.

7. The reinforced joint as recited in claim 6, wherein the pressing means includes means for locking the plates in a clamped position.

8. The reinforced joint as recited in claim 7, wherein said locking means includes at least one tongue and at least one slot on each plate, and wherein the one tongue on one plate is lockingly received in the one slot on the other plate.

9. The reinforced joint as recited in claim 6, wherein one plate has an opening through which the ribbon end regions are inserted to form a loop, and wherein the other plate is received, at least in part, within said loop.

10. The reinforced joint as recited in claim 9, wherein said other plate has a clip portion located exteriorly of said loop and a pair of leg portions situated at opposite side edges of the ribbon end regions.

11. The reinforced joint as recited in claim 2; and further comprising an adhesive layer disposed between, and adhering, the pressed ribbon end regions to each other.

12. The reinforced joint as recited in claim 2, wherein the securing means includes an adhesive coating disposed between one of the clamping portions and the container.

13. The reinforced joint as recited in claim 12, wherein the adhesive layer and the adhesive coating are pressure-sensitive glues.

14. The reinforced joint as recited in claim 2, wherein the container is a shopping bag having a bottom, and wherein the securing means secures the pressed and adhered ribbon end regions to the bottom of the bag inside the same.

15. In a carrying container of the type having a ribbon which serves as a carrying handle during carrying of an object within the container, a reinforced joint for joining opposite, generally planar, longitudinally extending, and overlapping ribbon end regions of the ribbon to each other, said joint comprising:

(a) means for pressing the overlapping ribbon end regions toward each other, including a pair of generally planar clamping portions, each located at an outer surface of a respective ribbon end region and being in pressing contact with the respective ribbon end region for maintaining the ribbon end regions in longitudinal alignment and in an overlapping relationship;

(b) an adhesive layer disposed between, and adhering, the pressed ribbon end regions to each other; and (c) means for securing the pressing means and, in turn, the pressed and adhered ribbon end regions to the container, for resisting displacement of the pressed and adhered ribbon end regions relative to the container when the pressed and adhered ribbon end regions are pulled in opposite longitudinal directions by the weight of the object being carried in the container.

16. In a decorative carrying bag of the type having a pull ribbon which, when pulled, simultaneously forms a decoration and a carrying handle for the bag, a reinforced joint for joining opposite, generally planar, longitudinally extending, and overlapping ribbon end regions of the ribbon to each other, said joint comprising:

(a) means for pressing the overlapping ribbon end regions toward each other, including a pair of generally planar clamping portions, each located at an outer surface of a respective ribbon end region and being in pressing contact with the respective ribbon end region for maintaining the ribbon end regions in longitudinal alignment and in an overlapping relationship;

(b) an adhesive layer disposed between, and adhering, the pressed ribbon end regions to each other; and (c) an adhesive coating disposed between, and adhering, one of the clamping portions to an interior wall of the bag, for adhesively securing the ribbon end regions to said interior bag wall to resist displacement of the ribbon end regions relative to said interior bag wall when an object being carried in the bag pulls the ribbon end regions in opposite longitudinal directions.

17. A method of securing o a carrying container opposite, generally planar, longitudinally extending and overlapping ribbon end regions of a ribbon which serves as a carrying handle for the container, comprising the steps of:

(a) positioning one generally planar clamping portion at an outer surface of one of the overlapping ribbon end regions;

(b) positioning another generally planar clamping portion at an outer surface of the other of the overlapping ribbon end regions;

(c) pressing the overlapping ribbon end regions together by urging the clamping portions toward each other; and (d) retaining the overlapping ribbon end regions to the container by connecting one of the clamping portions to the container.

* * * * *